United States Patent [19]

Kawamura

[11] Patent Number: 4,902,994

[45] Date of Patent: Feb. 20, 1990

[54] DEFLECTING DEVICE FOR A CATHODE RAY TUBE

[75] Inventor: Masaharu Kawamura, Kanagawa, Japan

[73] Assignee: International Business Machines Corporation, Armonk, N.Y.

[21] Appl. No.: 242,393

[22] Filed: Sep. 9, 1988

[30] Foreign Application Priority Data

Sep. 9, 1987 [JP] Japan ..... 62-224231

[51] Int. Cl.[4] ..... H01F 7/00

[52] U.S. Cl. ..... 335/210; 335/213

[58] Field of Search ..... 335/210, 213; 313/420, 313/426, 427, 428

[56] References Cited

U.S. PATENT DOCUMENTS

| | | | |
|---|---|---|---|
| 3,808,568 | 4/1974 | Sawyer | 335/210 |
| 3,895,379 | 7/1975 | Logan et al. | 335/213 X |
| 4,081,773 | 3/1978 | Nitzsche | 335/213 |
| 4,471,261 | 9/1984 | Meier et al. | 335/210 X |
| 4,754,248 | 6/1988 | Belich | 335/210 |

FOREIGN PATENT DOCUMENTS

| | | |
|---|---|---|
| 57-29238 | 6/1982 | Japan . |
| 57-029825 | 6/1982 | Japan . |
| 57-040621 | 8/1982 | Japan . |
| 59-024118 | 7/1984 | Japan . |
| 61-114754 | 7/1986 | Japan . |

OTHER PUBLICATIONS

*NHK Technical Journal*, vol. 17, No. 6, 1965, pp. 367–415.

*Philips Tech. Rev.*, 39, No. 6/7, pp. 154–171; "The Deflection Coil of the 30AX Colour-Picture System", by W. A. L. Heijnemans et al.

*Primary Examiner*—George Harris

*Attorney, Agent, or Firm*—Marc D. Schechter

[57] ABSTRACT

A deflector for a cathode ray tube (called herein "CRT"), and more particularly a stator type deflector in which a plurality of slots for windings are formed in the inner surface of a tubular core and deflecting coils are positioned in these slots. Both convergence (spot) distortion and raster (pin cushion) distortion are small. The magnetic field distribution at the neck is a barrel type, and that at the screen is a pin cushion type. Both the horizontal and the vertical magnetic fields are obtained by adjusting the positioning of the winding slots formed in the inner surface of the tubular core for positioning the deflecting coils. This is accomplished by adjusting the angles of the plurality of winding slots formed in the inner surface of the tubular core which contain the deflecting coils.

10 Claims, 8 Drawing Sheets

1 ---------- TUBULAR CORE
4a ~ 4t --- WINDING SLOTS

DEFLECTING DEVICE FOR A CATHODE RAY TUBE

BACKGROUND OF THE INVENTION

This invention relates to a deflector for a cathode ray tube (hereinafter called a "CRT"), and more particularly to a stator type deflector in which a plurality of slots for windings are formed in the inner surface of a tubular core and deflecting coils are positioned in these slots.

Most important among the characteristics required for a deflector for a CRT are that both convergence (spot) distortion and raster (pin cushion) distortion are small. This requires making a barrel type magnetic field distribution at the neck of the cathode ray tube, and making a pin cushion type magnetic field distribution at the screen of the tube (see "NHK Technical Journal," Vol. 17, No. 6, 1965). Thus, the windings must be distributed in the barrel pattern at the neck side, and in the pin cushion pattern at the screen side. The conventional CRT deflectors mainly employ the saddle type or the toroidal type that make the manufacture of the windings easy.

Japanese Published Examined Patent Application (JPEPA)57-29825 discloses a toroidal type deflector yoke in which the angle between coils is gradually varied from the neck side to the screen side aling the tube axis to obtained the barrel type magnetic field distribution at the neck and the pin cushion type magnetic field distribution at the screen.

JPEPA 57-40621 discloses a saddle-toroidal type deflector yoke in which the angle of winding width of a vertical toroidal coil at the screen side viewed from the tube axis is made smaller than that at the neck side viewed from the tube axis to cause a pin cushion magnetic field at the screen side and a barrel magnetic field at the neck side.

However, the saddle type deflector yoke and the toroidal type deflector yoke have poor efficiency because of a poor degree of coupling, and a large core diameter or large dielectric loss, and cause the problem of much heat being generated if they are used for a CRT that has a high horizontal deflection frequency (e.g. for CAD/CAM or text files). In addition, because recent CRT displays are required to have smaller packages, wide angle deflection (such as 100 degree deflection) causes a serious problem in improving the efficiency of the deflector yoke.

Japanese Published Examined Utility Model Application (JPEUMA) 59-24118 (Japanese Patent Application 52-41952) discloses a stator type deflector in which a plurality of grooves are formed in the inner surface of a tubular (horn-shaped) magnetic core along the axis of a cathode ray tube. Horizontal and vertical deflecting coils are wound in such a manner that they are engaged in these grooves. Because the horizontal and the vertical deflecting coils are engaged in the grooves, the deflector can cause the inner surfaces of the coils to be as close to the outer surface of the cathode ray tube as possible so that the deflection efficiency can be improved.

Japanese Published Unexamined Utility Model Application (JPUUMA) 61-114754 [Japanese Utility Model Application (JUMA) 59-196942] discloses a stator type deflector in which the spot and the raster distortions are reduced by forming Y-shaped winding paths, which extend from an end with a smaller opening to the other end with a larger opening and which are bifurcated in the middle, on a funnel-shaped inner periphery, the inner diameter of which expands along the axis.

JPUUMA 57-29238 (JUMA 57-163259) also discloses a staor type deflector with high deflection efficiency. FIG. 10 shows a core used for the deflector disclosed in the specification, while FIG. 11 shows a stator where coils are wound on the core of FIG. 10. Referring to these figures, core 700 has winding slots 700*a*, 700*b*, 700*c* and 700*d* in which vertical deflection coil 800 is provided, and winding slots 700*e*, 700*f*, 700*g* and 700*h* in which horizontal deflection coil 900 is provided. Winding slots 700*a*, 700*b*, 700*c* and 700*d* are radially formed around the tube axis. Winding slots 700*e*, 700*f*, 700*g* and 700*h* are formed in such a manner that the first angle in the plane normal to the tube axis at the neck side between first line 300*n* connecting the tube axis to the center of the winding slot in the transverse direction and horizontal reference line 300 ($\theta$ni for slot 700*h*) is larger than an angle in the plane normal to the tube axis as the screen side between second line 300*s* connecting the tube axis to the center of the winding slot in the transverse direction and horizontal reference line 300 ($\theta$si for slot 700*h*). This makes the horizontal deflection distribution a pin cushion magnetic field.

The deflector yoke disclosed in JPEPA 57-29825 has toroidal windings, and has poor deflection efficiency as described. It also requires a special technique for fastening the windings by some means, so that it is difficult to obtain products with uniform quality in mass production.

The deflector yoke disclosed in JPEPA 57-40621 tends to improve mechanical stability when a toroidal coil is diagonally wound around a core. However, although it has the effect of reducing the amount of displacement of the winding from an intended position in winding conductors and after completion of winding of the conductors, dispersion may be caused in the distribution of the magnetic field depending on the accuracy of the winding. In addition, it is necessary to fix the conductors in the desired position with adhesives or the like after completion of the winding. Furthermore, because the deflector yoke is a toroidal type, it has poor deflection efficiency as described.

In the deflector disclosed in JPEUMA 59-24118, because the grooves wound with the deflecting coils are radially formed around the tube axis, it is impossible to vary the winding distribution at the neck side from that at the screen side by only the windings in the grooves, and the convergence distortion becomes large if the raster distortion is intended to be lowered, so that it is necessary to provide a separate coil for convergence.

The deflector disclosed in JPUUMA 61-114754 is difficult to produce because of its complicated structure, and causes substantially fixed winding distribution at the screen side.

In the deflector disclosed in JPEUMA 57-29238, because the slots in which the horizontal deflecting coils are positioned differ from those in which the vertical deflecting coils are positioned, the degree of freedom for the winding becomes one half of that for a conventional stator type deflector, in which both the horizontal and the vertical deflecting coils are positioned in all of the slots. Thus, the winding distribution becomes coarse, so that it is not suitable for a CRT with a large deflecting angle because, although desired magnetic field distribution is obtained near the tube axis, the magnetic field is disturbed as the windings become farther away from the tube axis. In addition, because the slots in which the vertical deflecting coils are positioned are formed along radial lines from the tube axis, the vertical winding distribution at the neck side cannot be varied from that at the screen side, so that it is impossible to make the vertical deflection magnetic field have a barrel distribution at the neck side and a pin cushion distribution at the screen side.

Therefore, both the improvement of the convergence at the upper and the lower ends of the screen, and the reduction of the raster distortion in the transverse direction cannot be accomplished. Thus, it is not suitable for the vertical type display that is recently being used in large numbers.

SUMMARY OF THE INVENTION

The invention eliminates the above-mentioned problems in the prior art, and provides a deflector for a CRT that has good convergence characteristics (spot characteristics) for both horizontal and vertical deflection and low raster distortion (pin cushion distortion), and consumes low power for deflection.

It is an object of this invention to provide a deflector for a cathode ray tube (herein called a "CRT"), and more particularly a stator type deflector which creates a barrel type magnetic field distribution at the neck side of the deflector, and which creates a pin cushion type magnetic field distribution at the screen side of the deflector for both the horizontal and the vertical deflection magnetic fields, by adjusting the positions of the winding slots formed in the inner surface of a tubular core.

It is another object of this invention to provide a stator type deflector for a cathode ray tube, in which no dispersion is caused in the distribution of the magnetic fields, there is obtained high deflection efficiency, and there is attained both reduced raster distortion and improved convergence (realization of self-convergence).

The invention attains the above objects by adjusting the angles of a plurality of winding slots that are formed in the inner surface of a tubular core to contain deflecting coils. That is, the winding slots are formed to be:

$\theta ni > \theta si$ in the first region of the tubular core, $\theta ni = \theta si$ in the second region of the tubular core, and $\theta ni < \theta si$ in the third region of the tubular core, $\theta ni$ is an angle in a plane normal to the tube axis at the neck side of the tubular core. $\theta ni$ is the angle between a line connecting the tube axis to the center of the winding slot, and a horizontal reference line. $\theta si$ is an angle in a plane normal to the tube axis at the screen side of the tubular core. $\theta$ si is the angle between a line connecting the tube axis to the center of the winding slot, and a horizontal reference line. By forming the winding slots in this manner, both the horizontal and the vertical deflection magnetic fields have a barrel distribution at the neck side of the tubular core and have a pin cushion distribution at the screen side of the tubular core.

DESCRIPTION OF THE PREFERRED EMBODIMENTS

Figure 1:
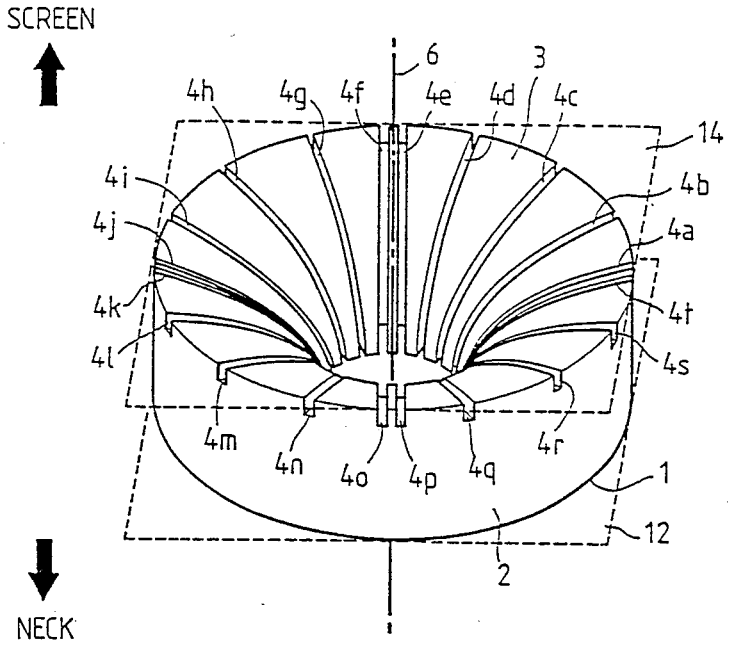
FIG. 1 shows a perspective view of an embodiment of a tubular core used for a deflector for a CRT according to the invention.

FIG. 1 is a perspective view of one embodiment of a tubular core used for the CRT deflector according to the invention. Referring to FIG. 1, external surface 2 of tubular core 1 is a cylinder, while inner surface 3 of tubular core 1 is a horn the diameter of which is increased from the neck to the screen along tube axis 6. Formed in inner surface 3 are winding slots 4*a*, 4*b*, 4*c*, 4*d*, 4*e*, 4*f*, 4*g*, 4*h*, 4*i*, 4*j*, 4*k*, 4*l*, 4*m*, 4*n*, 4*o*, 4*p*, 4*q*, 4*r*, 4*s* and 4*t*.

Figure 2:
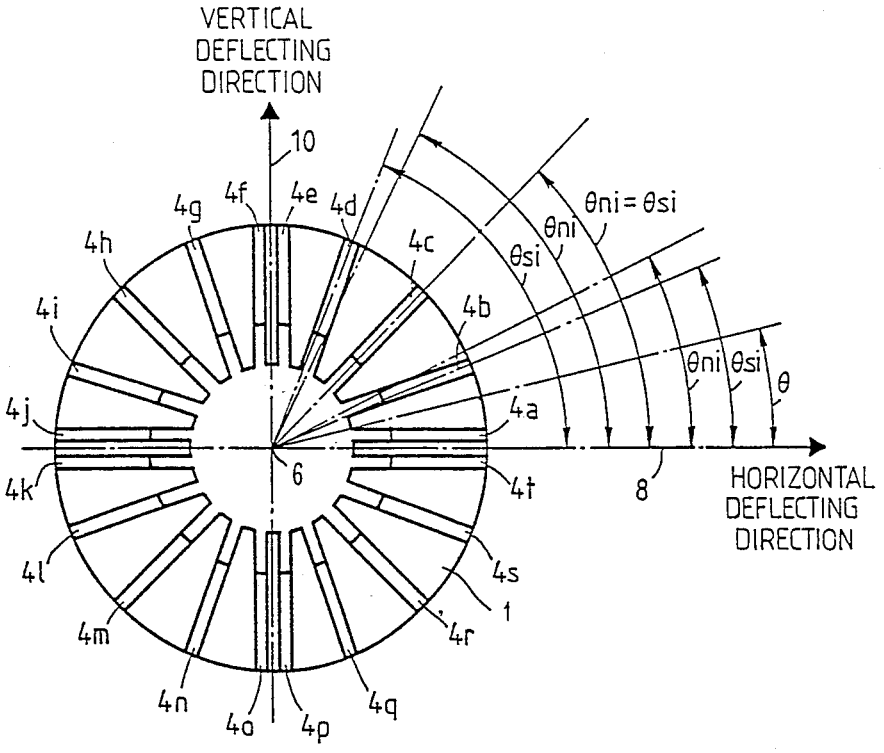
FIG. 2 shows a plane view of the tubular core shown in FIG. 1 viewed from the screen of the CRT.

FIG. 2 is a plane view of the tubular core 1 shown in FIG. 1 viewed from the screen side. Locations of winding slots 4*a* through 4*t* are described by referring to FIG. 2. Winding slots 4*a*, 4*b*, 4*f*, 4*g*, 4*k*, 4*l*, 4*p* and 4*q* are in regions satisfying the condition that the angle $\theta$ between the winding slot and horizontal reference line 8 in a plane normal to tube axis 6 is $0° < \theta < 45°$ $90° < \theta < 135°$ $180° < \theta < 225°$ and $270° < \theta < 315°$.

These winding slots satisfy the relation $\theta ni > \theta si$ wheren $\theta ni$ is an angle in plane 12 (FIG. 1) normal to tube axis 6 at the neck side of tubular core 1. $\theta ni$ is the angle between a line connecting tube axis 6 to the center of the winding slot, and horizontal reference line 8. $\theta si$ is an angle in plane 14 (FIG. 1) normal to tube axis 6 at the screen side of tubular core 1. $\theta si$ is the angle between a line connecting tube axis 6 to the center of the winding slot and horizontal reference line 8.

Winding slots 4*c*, 4*h*, 4*m* and 4*r* are in regions where the above-mentioned angle $\theta$ is $\theta = 45°, 135°, 225°$ and $315°$.

These winding slots satisfy the relation $\theta ni = \theta si$.

Winding slots 4*d*, 4*e*, 4*i*, 4*j*, 4*n*, 4*o*, 4*s* and 4*t* are in regions where the above-mentined angle $\theta$ is $45° < \theta < 90°$ $135° < \theta < 180°$
$225° < \theta < 270°$ and
$315° < \theta < 360°$.

The winding slots satisfy the relation
$\theta ni < \theta si$.

FIG. 2 shows the angles $\theta ni$ and $\theta si$ only for winding slots 4b, 4c and 4d.

Figure 3A:
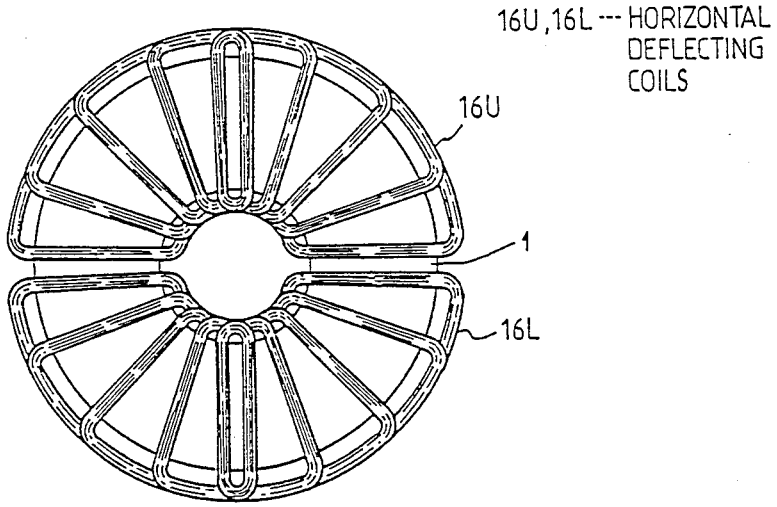
FIGS. 3A and 3B show plane views illustrating horizontal and vertical deflecting coils, respectively, wound around the core shown in FIGS. 1 and 2.
Figure 3B:
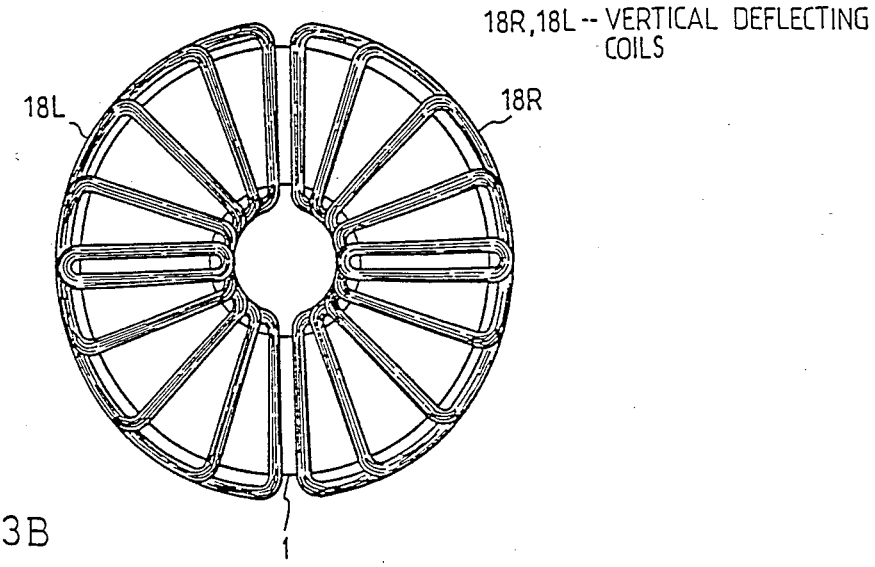

FIGS. 3A and 3B show horizontal deflecting coils and vertical deflecting coils, respectively, wound around core 1 shown in FIGS. 1 and 2. Referring to FIG. 3A, horizontal deflecting coil 16U is wound in winding slots 4a, 4b, 4c, 4d, 4e, 4f, 4g, 4h, 4i and 4j. Horizontal deflecting coil 16L is wound in winding slots 4k, 4l, 4m, 4n, 4o, 4p, 4q, 4r, 4s and 4t. Referring to FIG. 3B, vertical deflecting coil 18R is wound in winding slots 4a, 4b, 4c, 4d, 4e, 4p, 4q, 4r, 4s and 4t. Vertical deflecting coil 18L is wound in winding slots 4f, 4g, 4h, 4i, 4j, 4k, 4l, 4m, 4n and 4o. That is, winding slots 4a through 4t are wound with both the horizontal and the vertical deflecting coils.

Figure 4A:
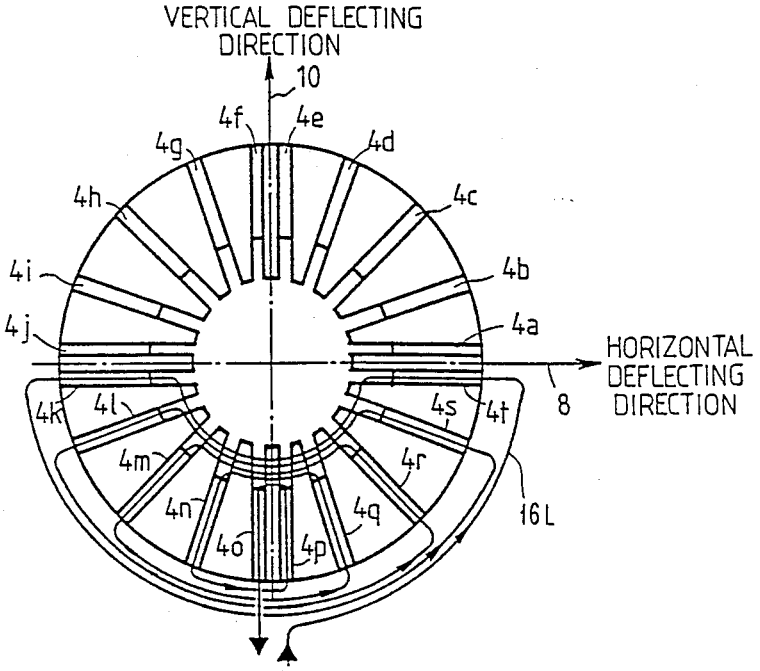
FIGS. 4A and 4B show schematic views illustrating examples of methods for winding the horizontal and vertical deflecting coils shown in FIGS. 3A and 3B, respectively.

FIG. 4A schematically shows horizontal deflecting coil 16L and how to wind it. As shown in the FIG. 4A, horizontal deflecting coil 16L is wound in winding slots 4t, 4k, 4s, 4l, 4r, 4m, 4q, 4n, 4p and 4o in this order.

Although not shown in FIG. 4A, horizontal deflecting coil 16U is wound symmetrically to horizontal deflecting coil 16L relative to horizontal reference line 8. That is, horizontal deflecting coil 16U is wound in winding slots 4a, 4j, 4b, 4i, 4c, 4h, 4d, 4g, 4e and 4f in this order.

Figure 4B:
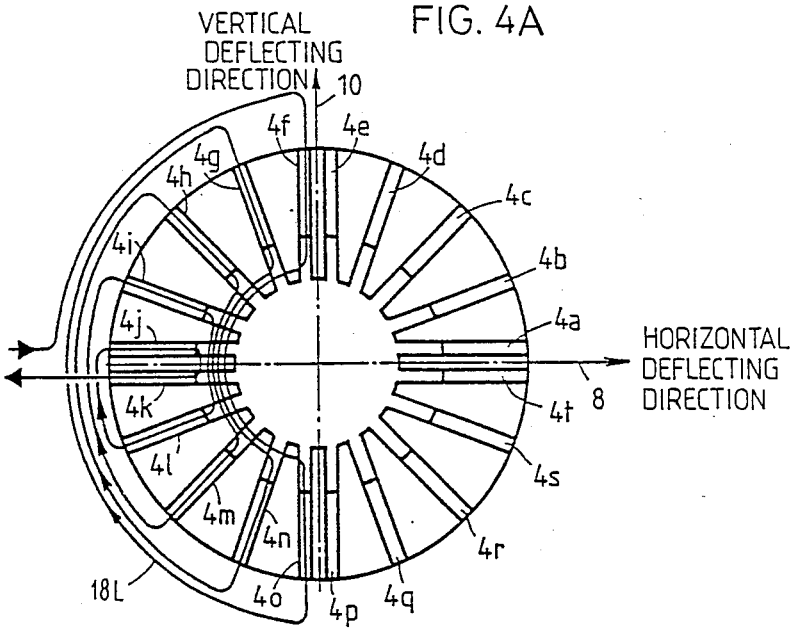

FIG. 4B schematically shows how to wind vertical deflecting coil 18L. As shown in the figure, vertical deflecting coil 18L is wound in winding slots 4f, 4o, 4g, 4n, 4h, 4m, 4i, 4l, 4j and 4k in this order.

Although not shown in FIG. 4B, vertical deflecting coil 18R is wound symmetrically to vertical deflecting coil 18L relative to vertical reference line 10 normal to tube axis 6 and horizontal reference line 8. That is, vertical deflecting coil 18R is wound in winding slots 4e, 4p, 4d, 4q, 4c, 4r, 4b, 4s, 4a and 4t in this order.

Figure 5:
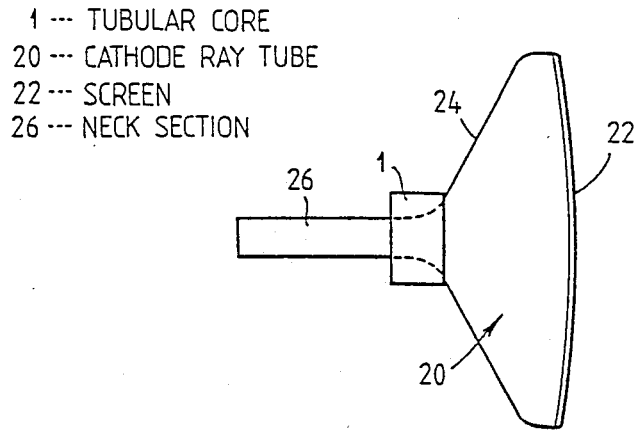
FIG. 5 shows a schematic view of the position of the core of the deflector on a cathode ray tube.

FIG. 5 shows the position of a core 1 of a deflector in a cathode ray tube 20. As shown in the FIG. 5, core 1 is positioned at the junction of funnel section 24 (from which cathode ray tube 20 expands its dimension toward screen 22) and neck section 26.

Figure 6A:
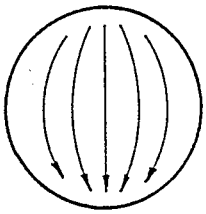
FIGS. 6A, 6B, 6C and 6D schematically illustrate examples of the horizontal and the vertical magnetic fields at the neck side of the core and at the screen side of the core generated by the deflector using the tubular core shown in FIGS. 1 and 2.
Figure 6B:
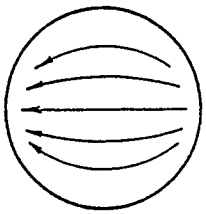
Figure 6C:
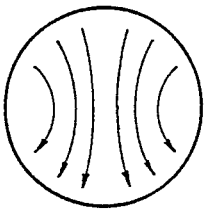
Figure 6D:
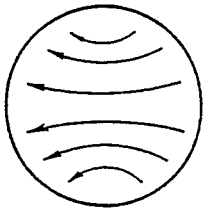

FIGS. 6A, 6B, 6C, and 6D show examples of horizontal and vertical deflection magnetic fields generated by the deflector using tubular core 1 formed with winding slots as shown in FIGS. 1 and 2. As shown in FIGS. 6A and 6B, both the horizontal and the vertical deflection magnetic fields at the neck side of core 1 assume a barrel distribution. As shown in FIGS 6C and 6D, both the horizontal and the vertical deflection magnetic fields at the screen side of core 1 assume the pin cushion distribution.

Now, a theoretical description will be made of the reason why it is possible to provide barrel distribution for the horizontal and the vertical magnetic fields at the neck, and pin cushion distribution for the horizontal and the vertical magnetic fields at the screen by forming winding slots 4a through 4t in tubular core 2 as shown in FIGS. 1 and 2.

Because the tubular core of the deflector is symmetrical relative to the horizontal plane and the vertical plane containing tube axis 6, a description of one of the four quadrants formed by the horizontal and vertical planes also applies to the other three quadrants. Therefore, the description is made here for the first quadrant or a region in which the above-mentioned angle $\theta$ is in the range of $0° < \theta < 90°$.

Figure 7:
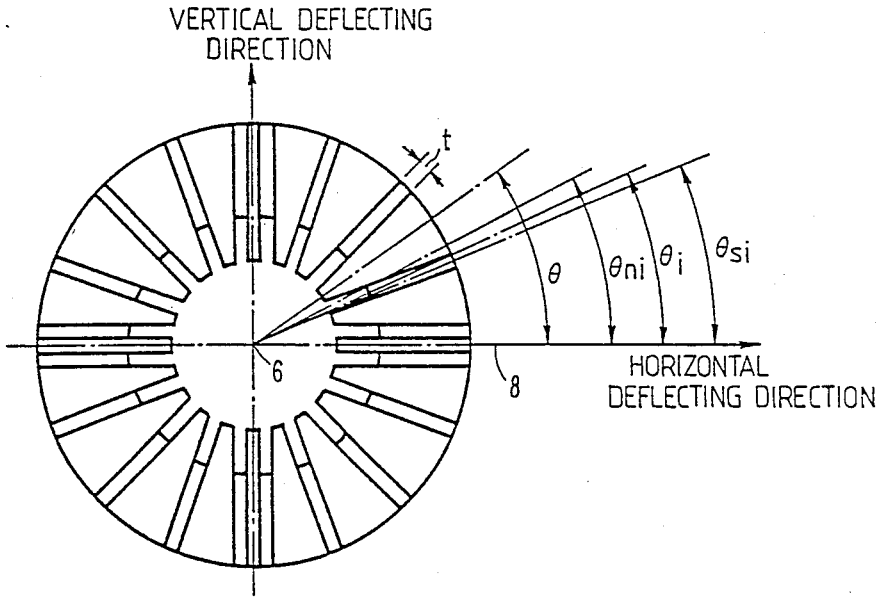
FIG. 7 schematically illustrates the parameters used for describing the principle of the invention.

Referring to FIG. 7, it is assumed that the number of winding slots in the first quadrant is m, and the slots are sequentially numbered as $i = 1, 2, \ldots m$, with slot one being nearest to horizontal reference line 8, and with $\theta(m+1) - (t/2) = (\pi/2)$ Then, the winding distribution is defined by magnetomotive force per unit current by assuming that an angle between a line connecting axis 6 to the center of the i-th winding slot in a plane normal to axis 6 and horizontal reference line 8 is $\theta i$, and that an angle between two lines connecting one end and another end of the winding slot in a plane normal to the tube axis 6 (namely, the angular of the width of the winding slot) is t. Because no magnetomotive force acts on the slot area, horizontal deflecting winding distribution $N(\theta)$ takes a discrete value, and can be expressed by the following equation:

$$N(\theta) = \begin{cases} Ni \left( \theta i + \frac{t}{2} \leqq \theta \leqq \theta(i+1) - \frac{t}{2} \right) \\ O \left( \theta i - \frac{t}{2} < \theta < \theta i + \frac{t}{2} \right) \end{cases}$$

When $N(\theta)$ is expanded in a Fourier series, $$N(\theta) = \frac{\pi}{4} (a_1 \sin\theta + a_3 \sin 3\theta + a_5 \sin 5\theta + \ldots)$$

$$a_j = \int_0^{\frac{\pi}{2}} N(\theta) \sin(j\theta) d\theta$$

According to the multipole theory described in a paper entitled "The deflection coils of the 30AX colour-picture system" by W. A. L. Heijnemans et al (*Philips Tech. Rev.*, Vol. 39, No. 6/7, pp. 154–171), the deflection magnetic field has a barrel distribution when $a_3 < 0$ and a pin cushion distribution when $a_3 > 0$.

The intensity of the barrel or the pin cushion is directly proportional to the absolute value of $a_3$.

Therefore, to obtain the barrel distribution at the neck side and the pin cushion distribution at the screen side for the deflection magnetic field, it is sufficient to position the winding slots in a manner in which $a_3$ increases toward the screen from the neck.

When $a_3$ is partially differentiated by $\theta i$, $$\frac{\partial a_3}{\partial \theta_i} = \sqrt{N(i-1)^2 + Ni^2 - 2N(i-1)Ni\cos 3t}$$

where, $$\sin 3(\theta i - \alpha i)$$

$$\alpha i = \frac{1}{3} \tan^{-1} \left[ \frac{N(i-1) + Ni}{N(i-1) - Ni} \tan \frac{3}{2} t \right]$$

As described, assuming that the angle in the plane normal to the tube axis at the neck side between the line connecting the tube axis 6 to the center of the winding slot and horizontal reference line 8 is $\theta ni$, and that the angle in the plane normal to the tube axis 6 at the screen side between the line connecting the tube axis 6 to the centerof the winding slot and horizontal reference line 8 is $\theta si$, $a_3$ increases at the screen side by making $\theta ni > \theta si$ in a region where $\theta i < \alpha i$, because in this region $(\partial a_3/\partial \theta i) < 0$.

On the other hand, $a_3$ increases at the screen side by making $\theta ni < \theta si$ in a region where $\theta i > \alpha i$, because in this region $(\partial a_3/\partial \theta i) > 0$ In addition, because $(\partial a_3/\partial \theta i) = 0$ in a regin where $\theta i = \alpha i$, $a_3$ is kept constant in this region by making $\theta ni = \theta si$.

Because the vertical deflecting winding has the center of the winding offset only by 90 degrees relative to the horizontal deflecting winding, the approach on horizonatal deflecting winding distribution $N(\theta)$ can be applied to vertical deflecting winding distribution $P(\theta)$. That is, vertical deflecting winding distribution $P(\theta)$ can be expressed as:

$$P(\theta) = \begin{cases} Pi\left(\theta i + \frac{t}{2} \leqq \theta \leqq \theta(i+1) - \frac{t}{2}\right) \\ O\left(\theta i - \frac{t}{2} < \theta < \theta i + \frac{t}{2}\right) \end{cases}$$

wherein $i = 1, 2, \ldots m$, and $\theta_o + (t/2) = 0$. When $P(\theta)$ is expanded into a Fourier series, $$P(\theta) = \frac{\pi}{4}(b_1 \cos\theta + b_3 \cos 3\theta + b_5 \cos 5\theta + \ldots)$$

$$b_j = \int_0^{\frac{\pi}{2}} P(\theta)\cos(j\theta)d\theta$$

According to the multipole theory, the deflection magnetic field assumes a barrel distribution when $b_3 > 0$, and pin cushion distribution when $b_3 > 0$.

The intensity of the barrel or the pin cushion is directly proportional to the absolute value of $b_3$.

Therefore, to obtain a barrel distribution at the neck and a pin cushion distribution at the screen for the deflection magnetic field, it is sufficient to position the winding slots in a manner in which $b_3$ increases toward the screen from the neck. When $b_3$ is partially differentiated by $\theta i$, $$\frac{\partial b_3}{\partial \theta_i} = \sqrt{P(i+1)^2 + Pi^2 - 2P(i+1)Pi\cos 3t}\ \sin 3(\theta i - \beta i)$$

where, $$\beta i = \frac{1}{3}\tan^{-1}\left[\frac{P(i+1) + Pi}{P(i+1) - Pi}\cot\frac{3}{2}t\right]$$

Thus, $b_3$ increases at the screen side by making $\theta ni > \theta si$ in a region where $\theta i < \beta i$, because in this region $(\partial b_3/\partial \theta i) < 0$.

On the other hand, $b_3$ increases at the screen side by making $\theta ni < \theta si$ in a region where $\theta i > \beta i$, because in this region $(\partial b_3/\partial \theta i) > 0$ In addition, because, $(\partial b_3/\partial \theta i = 0$ in a region where $\theta i = \beta i$, $b_3$ is kept constant in this region by making $\theta ni = \theta si$.

$\alpha i$ and $\beta i$ may have various values depending on width t of the winding slot and the number of the winding in the slot.

The case of $\alpha i \neq \beta i$

If $\gamma imin = MIN\ [\alpha i, \beta i]$ (whichever is the smaller angle of $\alpha i$ and $\beta i$)

$\gamma imax = MAX\ [\alpha i, \beta i]$ (whichever is the larger angle of $\alpha i$ and $\beta i$), then it is sufficient to make $\theta ni > \theta si$ in the first region satisfying $\theta < \gamma imin$ because $\theta < \alpha i$ $\theta < \beta i$ in this first region.

On the other hand, if $\theta ni \neq \theta si$ in the second region satisfying $\gamma imin \leqq \theta \leqq \gamma imax$, it is possible to obtain the barrel distribution at the neck and the pin cushion distribution at the screen for either the horizontal or the vertical deflection magnetic field, but impossible to obtain such distribution for the other magnetic field. Therefore, in the second region, the desired magnetic field is obtained by making $\theta ni = \theta si$.

In addition, it is sufficient to make $\theta ni < \theta si$ in the third region satisfying $\theta > \gamma imax$ because $\theta > \alpha i$ $\theta > \beta i$ in this third region.

The embodiment shown in FIGS. 1 and 2 is for a case where $m = 5$, $t = 6°$, and $\theta_1 = 9° < \gamma_1 min = 56°$ $\theta_2 = 27 < \gamma_2 min = 50°$ $\theta_3 = 45° = \gamma_3 min = \gamma_3 max$ $\theta_4 = 63° \eta \gamma_4 max = 39°$ $\theta_5 = 81° \gamma_5 max = 33°$ That is, in this embodiment, for the first quadrant in the range of $0° \leqq \theta \leqq 90°$, winding slots 4*a* and 4*b* in the first region where $\theta < 45°$ satisfy $\theta ni > \theta si$, winding slot 4*c* in the second region where $\theta = 45°$ satisfies $\theta ni = \theta si$, and winding slots 4*d* and 4*e* in the third region where $\theta > 45°$ satisfy $\theta ni < \theta si$.

For the second quandrant in the range of $90° \leqq \theta \leqq 180°$, winding slots 4*f* and 4*g* in the first region where $\theta < 135°$ satisfy $\theta ni > \theta si$, winding slot 4*h* in the second region where $\theta = 135°$ satisfies $\theta ni = \theta si$, and winding slots 4*i* and 4*j* in the third region where $\theta > 135°$ satisfy $\theta ni < \theta si$.

For the third quandrant in the range of $180° \leqq \theta \leqq 270°$, winding slots 4*k* and 4*l* in the first region where $\theta < 225°$ satisfy $\theta ni > \theta si$, winding slot 4*m* in the second region where $\theta = 225°$ satisfies $\theta ni = \theta si$, and winding slots 4*n* and 4*o* in the third region where $\theta > 225°$ satisfy $\theta ni < \theta si$.

For the fourth quadrant in the range of $270° \leqq \theta \leqq 360°$, winding slots $4_p$ and $4_q$ in the first region where $\theta < 315°$ satisfy $\theta ni > \theta si$, winding slot 4*r* in the second region where $\theta = 315°$ satisfies $\theta ni = \theta si$, and winding slots 4*s* and 4*t* in the third region where $\theta > 315°$ satisfy $\theta ni < \theta si$.

From the foregoing description, it is theoretically clear that the deflector using tubular core 1 shown in FIGS. 1 and 2 can generate the magnetic fields shown in FIGS. 6A through 6D.

As described, because m, t, $\alpha i$ and $\beta i$ may have various values, the invention is not limited to the embodiment shown in FIGS. 1 and 2.

Now, description is made of the lower limit of $\theta si$ in case of $\theta ni > \theta si$, and the upper limit in case of $\theta ni > \theta si$.

First, in considering a horizontal winding, if $a_3 = f(\theta si \ldots \theta ni)$, then $$\frac{\partial f}{\partial \theta si} = \sqrt{N(i-1)^2 + Ni^2 - 2N(i-1)Ni\cos 3t}\ \sin 3(\theta si - \alpha i)$$

Figure 8:
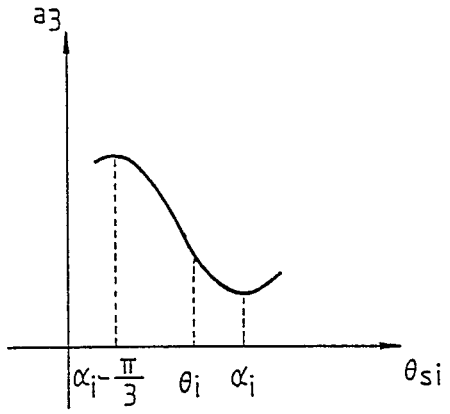
FIG. 8 is a graph illustrating the relation between $a_3$ and $\theta si$ in the case of $\theta ni > \theta si$.

As seen from the equation, $\partial f/\partial \theta si$ has a maximum or minimum value at $\theta si = \alpha i \pm (n/3)\pi$ In case of $\theta ni > \theta si$, as shown in FIG. 8, $a_3$ has a maximum value at $\theta si = \alpha i - (\pi/3)$.

Since $a_3$ decreases in the range of $\theta si < \alpha i - (\pi/3)$ the lower limit value is determined to be $\theta si = \alpha i - (\pi/3)$.

Figure 9:
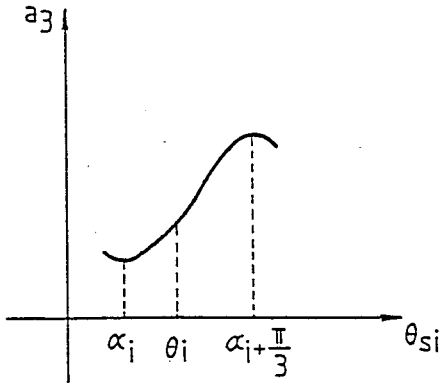
FIG. 9 is a graph illustrating the relation between $a_3$ and $\theta si$ in the case of $\theta ni < \theta si$.
Figure 10:
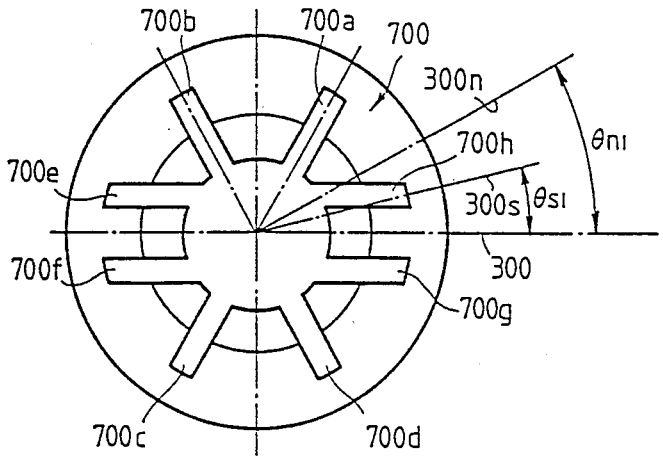
FIG. 10 shows an example of a core for a conventional stator type deflector viewed from the screen of the CRT.
Figure 11:
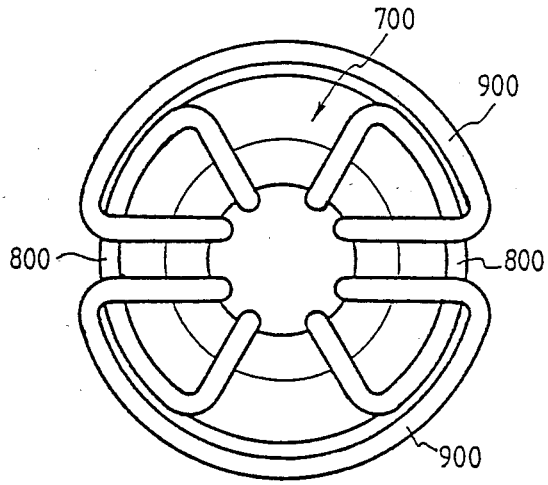
FIG.11 shows the horizontal and the vertical deflecting coils wound around the core shown in FIG. 10.

In case of $\theta ni < \theta si$, as shown in FIG. 9, $a_3$ has a maximum value at $\theta si = \alpha i + (\pi/3)$.

Since $a_3$ decreases in the range of $\theta si > \alpha i + (\pi/3)$.

the upper limit value is determined to be $\theta si = \alpha i + (\pi/3)$

The above consideration for $a_3$ are true for $b_3$. Therefore, for the vertical winding, the lower limit of $\theta si$ is $\theta si = \beta i - (\pi/3)$ and the upper limit of $\theta si$ is $\theta si = \beta i + (\pi/3)$ As described, if $\gamma imin = MIN[\alpha i, \beta i]$ $\gamma imax = MAX[\alpha i, \beta i]$ the lower limit of $\theta si$ is $\theta si = \gamma imax - (\pi/3)$ and the upper limit is $\theta si = \gamma imin + (\pi/3.)$ In the embodiment shown in FIGS. 1 and 2, because $\gamma_1$ max is 57° and $\gamma_2$ max is 52°, the lower limits of $\theta s_1$ and $\theta s_2$ are −3° and −8°, respectively, while, because $\gamma_4$ min is 38° and $\gamma_5$ min is 30°, the upper limits of $\theta s_4$ and $\theta s_5$ are 98° and 90°, respectively. As described, because $\alpha i$ and $\beta i$ may take various values, the lower and the upper limits of $\theta si$ are not limited to −3°, −8°, and 98°, 90°.

Although FIGS. 4A and 4B show an example of how to wind the horizontal deflecting coil and the vertical deflecting coil, the invention is not limited to such an arrangement, but can employ any method for winding the deflecting coil as long as the windings are provided in the slots to create a magnetomotive force between the slots.

Although in the embodiment shown in FIGS. 1 and 2, the inner surface of the tubular core is formed with the winding slots in a horn shape the diameter of which increases toward the screen from the neck, the invention is not limited to such an arrangement, but the diameter may be uniform or may be gradually reduced.

Because the invention obtains a barrel distribution at the neck side of tubular core 1 and pin cushion distribution at the screen side of tubular core 1 for both the horizontal and the vertical deflection magnetic fields by adjusting the positioning of the winding slots formed in the inner surface of the tubular core for positioning the deflecting coils, it can maintain the features of the stator type deflector, in which no dispersion is caused in the distribution of the magnetic fields and there is high deflection efficiency, and can attain both reduction of the raster distortion and improvement of convergence (realization of self-convergence).

I claim:

1. In a deflecting device for a cathode ray tube in which a plurality of winding slots are formed in the inner surface of a tubular core, in which slots deflecting coils are positioned, when $\theta ni$ is an angle in a plane normal to the tube axis at the neck between a line connecting said tube axis to the center of said winding slot in the transverse direction and a reference line in the horizontal direction, and $\theta si$ is an angle in a plane normal to the tube axis at the screen between a line connecting said tube axis to the center of said winding slot in the transverse direction and a reference line in the horizontal direction, said winding slots being formed to be $\theta ni > \theta si$ in a first region of said tubular core, $ni = \theta si$ in a second region of said tubular core, and $\theta ni < \theta si$ in a third region of said tubular core.

2. A deflecting device for a cathode ray tube claimed in claim 1, wherein, when Γimin is the first angle in the first quadrant in a plane normal to said tube axis between a first line passing through said tube axis and said reference line in the horizontal direction, and $\gamma imax$ is an angle in said first quadrant between a second line passing through said tube axis and said reference line in the horizontal direction, said first region is a region of $\theta$ satisfying $\theta < \gamma imin$, said second region being a region of $\theta$ satisfying $\gamma imin \leqq \theta \leqq \gamma imax$, said third region being a region of $\theta$ satisfying $\gamma imax < \theta$.

3. A deflecting device for a cathode ray tube claimed in claim 2, wherein, when a plurality of winding slots contained in the first quadrant in a plane normal to said tube axis are numbered as $i = 1, 2, \ldots m$ from one nearest to said reference line in the horizontal direction, $\theta i$ is an angle between the center of i-th winding slot in the transverse direction and said reference line in the horizontal line, t is an angle in a plane normal to said tube axis between two lines connecting one end and other end of said winding slot in the transverse direction to the tube axis respectively, $$\alpha i = \frac{1}{3} \tan^{-1} \left[ \frac{N(i-1) + Ni}{N(i-1) - Ni} \tan \frac{3}{2} t \right]$$

$$\beta i = \frac{1}{3} \tan^{-1} \left[ \frac{P(i+1) - Pi}{P(i+1) + Pi} \cot \frac{3}{2} t \right]$$

wherein Ni is the magnetomotive force by the horizontal deflecting coil and $Pi+1$ is that by the vertical deflecting coil in a region of $\theta i + (t/2) \leqq \theta \leqq \theta(i+1) - (t/2)$ said $\gamma imin$ is said $\alpha i$ or said $\beta i$ whichever smaller, said $\gamma imax$ being said $\alpha i$ or said $\beta i$ whichever larger.

4. A deflecting device for a cathode ray tube claimed in claim 2 or 3, wherein for the winding slot formed to be $\theta ni > \theta si$, the lower limit of $\theta si$ is $\gamma imax - (\pi/3)$ while, for the winding slot formed to be $\theta ni < \theta si$, the upper limit of $\theta si$ is $\gamma imin + (\pi/3)$

5. A deflecting device for a cathode ray tube claimed in claim 4, wherein said $\alpha i$ and said $\beta i$ have different value with each other.

6. A deflecting device for a cathode ray tube claimed in claim 4, wherein said $\alpha i$ equals to said $\beta i$.

7. A deflecting device for a cathode ray tube claimed in claim 6, wherein said $\alpha i$ and said $\beta i$ are 45° in the first quadrant in a plane normal to said tube axis.

8. In a deflecting device for a cathode ray tube in which a plurality of winding slots are formed in the inner surface of a tubular core, in which slots deflecting coils are positioned, comprising:

means for obtaining barrel distribution of the magnetic at the neck side of said tube and obtaining pin cushion distribution of the magnetic field at the screen side for both the horizontal and the vertical deflection magnetic fields, by adjusting the positioning of the winding slots in the inner surface of the tubular core, whereby no dispersion is caused in the distribution of of the magnetic fields and there is high deflection efficiency, and there are attained both reduction of raster distortion and improvement of convergence.

9. A deflecting device for a cathode ray tube having a neck and a screen, said deflecting device comprising:

a tubular core having an inner surface comprising a plurality of winding slots, said tubular core having a neck end arranged toward the neck of the cathode ray tube, said tubular core having a screen end arranged toward the screen of the cathode ray tube, said tubular core having an axis extending from the neck end to the screen end of the tubular core;

at least one deflecting coil arranged in the winding slots;

characterized in that:

there is a normal plane which is normal to the axis of the tubular core;

an angle $\theta ni$ is formed between the projections in the normal plane of (i) a line connecting the tube axis to the center of the i'th winding slot at the neck end of the tubular core, and (ii) a reference line in a horizontal direction;

an angle $\theta si$ is formed between the projections in the normal plane of (i) a line connecting the tube axis to the center of the i'th winding slot at the screen end of the tubular core, and (ii) the reference line in the horizontal direction;

in a first region of the tubular core the winding slots satisfy $\theta ni > \theta si$; and in a second region of the tubular core the winding slots satisfy $\theta ni < \theta si$.

10. A deflecting device as claimed in claim 9, characterized in that:

the deflecting device comprises a plurality of horizontal deflecting coils arranged in the winding slots for deflecting an electron beam in the cathode ray tube in the direction of the horizontal reference line;

the deflecting device comprises a plurality of vertical deflecting coils arranged in the winding slots for deflecting an electron beam in the cathode ray tube in a direction perpendicular to the direction of the horizontal reference line and perpendicular to the axis of the tubular core;

an angle $\theta i$ is formed between the projections in the normal plane of (i) a line connecting the tube axis to the center of the i'th winding slot at a position halfway between the neck end of the tubular core and the screen end of the tubular core, and (ii) the reference line in the horizontal direction;

an angle $\alpha i$ is defined by $$\alpha i = \frac{1}{3} \tan^{-1} \left[ \frac{N(i-1) + Ni}{N(i-1) - Ni} \tan \frac{3}{2} t \right];$$

an angle $\beta i$ is defined by $$\beta i = \frac{1}{3} \tan^{-1} \left[ \frac{P(i+1) - Pi}{P(i+1) + Pi} \cot \frac{3}{2} t \right];$$

Ni is the magnetomotive force generated by the i'th horizontal deflecting coil and Pi+1 is the magnetomotive force generated by the i'th vertical deflecting coil in an angular region $\theta$ given by $$\theta i + \frac{t}{2} \leqq \theta \leqq \theta(i+1) - \frac{t}{2};$$

the first region is defined by $\theta i < \gamma imin$, where $\gamma imin$ is the smaller of $\alpha i$ and $\beta i$;

the second region is defined by $\theta i > \gamma imax$, where $\gamma imax$ is the greater of $\alpha i$ and $\beta i$.

* * * * *